US007086543B2

(12) United States Patent
Remmers

(10) Patent No.: US 7,086,543 B2
(45) Date of Patent: Aug. 8, 2006

(54) STANDARD AND TRACK SHELVING SYSTEMS

(75) Inventor: Lee E. Remmers, Ocala, FL (US)

(73) Assignee: Clairson, Inc., Newark, DE (US)

( * ) Notice: Subject to any disclaimer, the term of this patent is extended or adjusted under 35 U.S.C. 154(b) by 0 days.

(21) Appl. No.: 11/194,849

(22) Filed: Aug. 1, 2005

(65) Prior Publication Data

US 2005/0284828 A1 Dec. 29, 2005

Related U.S. Application Data

(62) Division of application No. 10/657,855, filed on Sep. 9, 2003, now Pat. No. 6,953,176.

(51) Int. Cl.
*A47F 5/08* (2006.01)
*A47B 96/07* (2006.01)

(52) U.S. Cl. ..... 211/94.01; 211/113; 211/118; 211/162; 211/186; 248/222.51; 248/225.11; 312/132

(58) Field of Classification Search ..... 211/94.01, 211/162; 248/225.11, 225.21; 312/132
See application file for complete search history.

(56) References Cited

U.S. PATENT DOCUMENTS

| | | | | |
|---|---|---|---|---|
| 3,208,406 | A | 9/1965 | Maslow | |
| 3,225,720 | A | 12/1965 | Maslow | |
| 3,717,258 | A * | 2/1973 | McKimmon | 211/87.01 |
| 3,763,794 | A | 10/1973 | Fleck | |
| 4,004,526 | A | 1/1977 | King | |
| 4,311,295 | A * | 1/1982 | Jamar, Jr. | 248/222.11 |
| 4,403,761 | A * | 9/1983 | Jamar | 248/447.1 |
| D275,434 | S | 9/1984 | Taub | |
| D286,495 | S | 11/1986 | Blomdahl | |
| 4,666,201 | A | 5/1987 | Chap | |
| 4,678,151 | A | 7/1987 | Radek | |
| 4,694,966 | A | 9/1987 | Sorenson et al. | |
| 4,771,897 | A * | 9/1988 | Ho | 211/85.9 |
| 4,843,977 | A | 7/1989 | Bridges | |
| 5,027,959 | A | 7/1991 | Luukkonen | |
| 5,050,832 | A * | 9/1991 | Lee et al. | 248/225.11 |
| 5,101,989 | A | 4/1992 | Jones | |
| 5,110,080 | A * | 5/1992 | Rieman | 248/225.11 |
| 5,135,194 | A | 8/1992 | Laughon et al. | |

(Continued)

FOREIGN PATENT DOCUMENTS

| | | |
|---|---|---|
| CA | 2245809 | 8/1998 |

OTHER PUBLICATIONS

U.S. Appl. No. 60/434,470, filed Dec. 18, 2002, Costa et al.

*Primary Examiner*—Richard E. Chilcot, Jr.
*Assistant Examiner*—Jared W. Newton
(74) *Attorney, Agent, or Firm*—Harness, Dickey & Pierce, P.L.C.

(57) ABSTRACT

In one embodiment, a shelving apparatus generally includes a track and a standard. The track includes a support portion having an upper support surface and an extension extending generally outwardly from the support portion. The standard includes a back surface having an opening. When the support portion is within the opening, an upper surface of the opening contacts the upper support surface of the support portion, and the extension is engagingly received within a portion of the opening. This engagement of the extension within the portion of the opening can inhibit disengagement of the standard from the track.

20 Claims, 4 Drawing Sheets

U.S. PATENT DOCUMENTS 5,185,971 A 2/1993 Johnson, Jr.
5,513,908 A 5/1996 Williams
5,549,379 A * 8/1996 Jun et al. ..... 312/408
5,638,644 A 6/1997 Bastian
5,725,110 A 3/1998 Kluge et al.
5,819,958 A 10/1998 Dement
5,897,002 A 4/1999 Carlino
6,050,426 A 4/2000 Leurdijk
D425,734 S 5/2000 Bauer
6,119,878 A 9/2000 Zen
6,135,298 A 10/2000 Lechman
6,290,075 B1 9/2001 Cheimets et al.
6,460,469 B1 10/2002 Dickinson et al.
6,520,355 B1 2/2003 Pritchard et al.
6,575,315 B1 6/2003 Zidek
6,659,295 B1 12/2003 De Land et al.
6,666,153 B1 12/2003 Dickinson et al.
6,669,154 B1 12/2003 Remmers
6,758,355 B1 7/2004 Zedek
2004/0007549 A1 1/2004 Klein et al.
2004/0045919 A1 3/2004 Remmers
2005/0011420 A1 1/2005 Costa et al.
2005/0145588 A1 7/2005 Stitchick et al.

* cited by examiner

STANDARD AND TRACK SHELVING SYSTEMS

CROSS-REFERENCE TO RELATED APPLICATIONS

This application is a divisional of presently allowed U.S. patent application Ser. No. 10/657,855 filed Sep. 9, 2003, now U.S. Pat. No. 6,953,176, which, in turn, claimed priority to U.S. patent application Ser. No. 09/436,363 filed Nov. 9, 1999, now U.S. Pat. No. 6,669,154, issued Dec. 30, 2003. The disclosures of the above applications are incorporated herein by reference.

FIELD OF THE INVENTION

The present invention relates generally to the use of vertical support standards to support shelving brackets. More particularly, it concerns the combination of a vertical support standard and track system that provides greater support and consumer flexibility to closet shelving arrangements.

BACKGROUND OF THE INVENTION

Vertical support standards for the purpose of supporting shelving brackets are well known in the art. These standards are often comprised of narrow strips that may be mounted vertically against a wall and contain a plurality of slots such that tabs of shelving brackets can be inserted and supported by such standards. Vertical shelving standards are typically mounted to a wall through screws or other means such that the standard is not generally mobile or removable from its position if desired by the consumer after installation. Additional improvements thus in the manner of flexibility in positioning such standards combined with added strength and load bearing capacity thus remains warranted.

SUMMARY OF THE INVENTION

According to one aspect of the invention, an exemplary shelving apparatus generally includes a track and a standard. The track includes a support portion having an upper support surface and an extension extending generally outwardly from the support portion. The standard includes a back surface having an opening. When the support portion is within the opening, an upper surface of the opening contacts the upper support surface of the support portion, and the extension is engagingly received within a portion of the opening. This engagement of the extension within the portion of the opening can inhibit disengagement of the standard from the track.

According to another aspect, the present invention methods of supporting standards with a track. In one particular implementation, the track includes a support portion having an upper support surface and an extension extending generally outwardly from the support portion. The standard includes a back surface having an opening configured to engagingly receive the support portion. The method generally includes positioning the standard relative to the track such that a portion of the opening engages the extension, the opening engages the support portion of the track, and the upper support surface of the support portion contacts an upper surface of the opening.

According to another aspect, an exemplary shelving apparatus includes a standard and a track. The standard includes a back surface having an opening. The track includes means for supporting the standard. The track also includes means for retaining the standard within the track. When the standard is engaged with the track, an upper surface of the opening contacts the means for supporting, and the means for retaining contacts a portion of the opening.

Further aspects and features of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The following drawings form part of the specification and are included to further demonstrate certain aspects of the present invention. The invention may be better understood by reference to one or more of these drawings in combination with the detailed description presented herein.

DETAILED DESCRIPTION OF THE EXEMPLARY EMBODIMENTS

Figure 1:
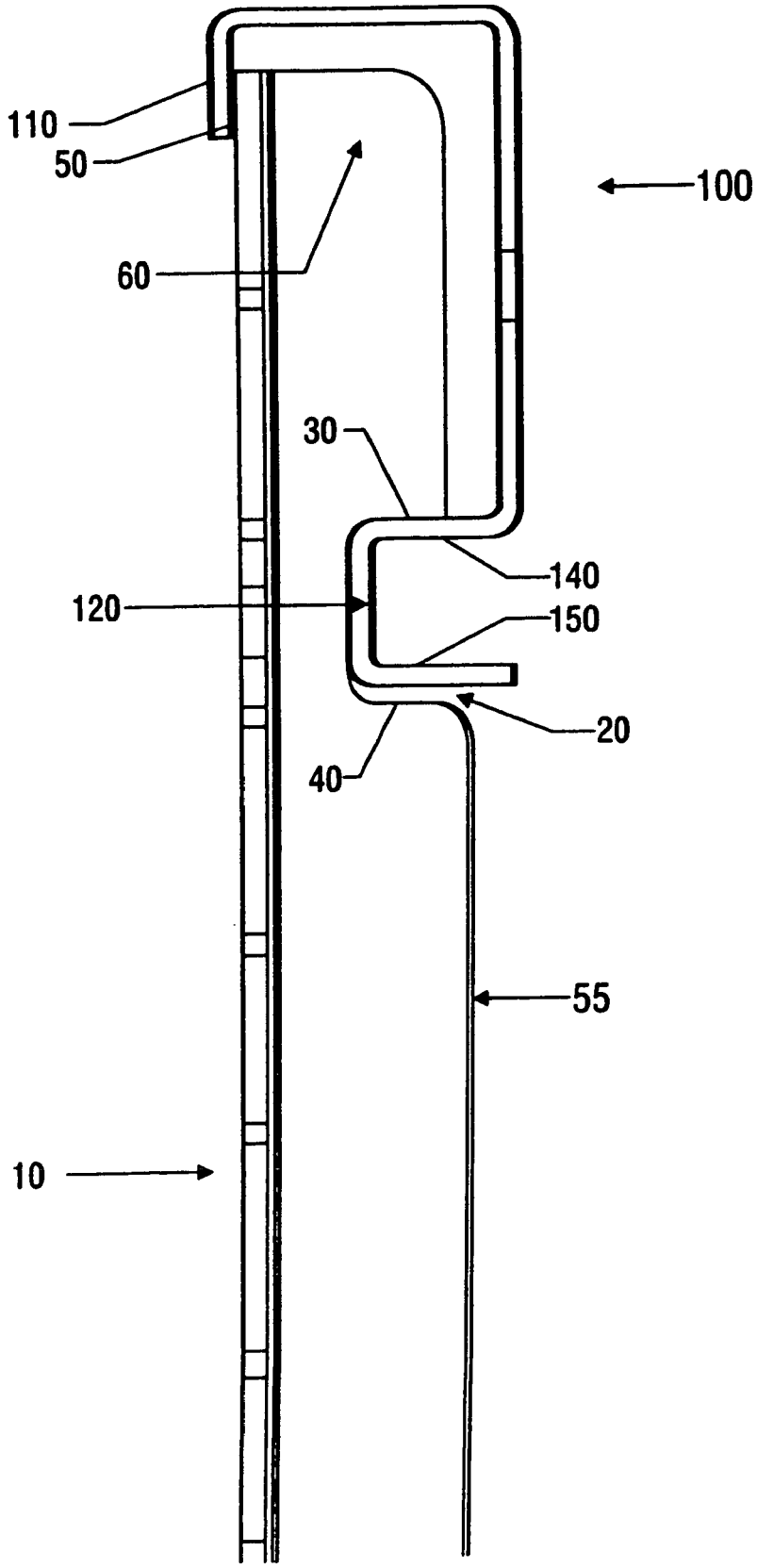
FIG. 1 is a side view of an embodiment of a shelving apparatus.

The following descriptions of various embodiments are merely exemplary in nature and are in no way intended to limit the invention, its application, or uses.

Aspects of the present invention generally relate to a vertical support standard and track system for supporting shelving brackets, such that the standard is able to receive greater loading capacity and can be moved prior to final positioning, if desired, to various positions across a wall through use of a track. In various embodiments, the horizontally mounted track provides added support to increase the loading that can be placed on the standard and also provides the ability for such standard to be moved to various positions along the track's length. Illustratively, one embodiment of the invention generally includes a shelving apparatus containing a vertical support standard and a track. Embodiments of the invention can also include a shelf and shelving bracket mounted to the standard. The standard may be constructed like a typical wall mounted standard having front and back sides. The front side of the standard may contain a plurality of slots so as to be able to receive tabs or other mounting means of a shelving bracket. The standard can contain one or more columns of slots so as to accept one or more shelving brackets or multi-sided shelving brackets. The back side of the standard, preferably near a top portion, defines an opening having upper and lower surfaces. This opening should preferably be constructed in such a way that it can receive a support portion of a track. The standard may also be able to be moved horizontally along a wall mounted track without becoming detached from the track.

Another component in embodiments of the invention is a track which can be mounted to a wall by any typical mounting means. The track comprises a body which is able to accept a standard. In order to keep such a standard mounted to the track, various embodiments include a track having a lip that extends downwardly and overlaps a front surface of the top portion of the standard so as to prevent the standard from disengaging from the track. The track can also include a support portion having upper and lower surfaces that is adapted to be inserted into the opening on the back of the standard. The opening on the standard and the support portion of the track are preferably aligned so that the front lip of the track is able to engage a front portion of the standard.

The top portion of the standard that engages the lip of the track, and the upper surface of the opening that engages the upper surface of the support portion of the track, provide support for downward loading placed on the standard and keep the standard locked into the track. The lower surface of the opening prevents the standard from being pushed up and disjointed from the track by engaging the lower surface of the support portion of the track. When mounted on the track, the standard is preferably able to move horizontally along the support portion so as to be placed in a desired position by the consumer prior to first mounting of the standard to a wall. In this way, a shelf bracket and shelving system can be mounted to the standard in a location preferable to the consumer while providing maximum support and accepting greater amount of loading such as by an attached bracket and shelf.

According to another aspect of the invention, an exemplary shelving apparatus generally includes a track and a standard. The track includes a support portion having an upper support surface and an extension extending generally outwardly from the support portion. The standard includes a back surface having an opening. When the support portion is within the opening, an upper surface of the opening contacts the upper support surface of the support portion, and the extension is engagingly received within a portion of the opening. This engagement of the extension within the portion of the opening can inhibit disengagement of the standard from the track.

According to another aspect, the present invention methods of supporting standards with a track. In one particular implementation, the track includes a support portion having an upper support surface and an extension extending generally outwardly from the upper support surface. The standard includes a back surface having an opening configured to engagingly receive the support portion. The method generally includes positioning the standard relative to the track such that a portion of the opening engages the extension, the opening engages the support portion of the track, and the upper support surface of the support portion contacts an upper surface of the opening.

According to another aspect, an exemplary shelving apparatus includes a standard and a track. The standard includes a back surface having an opening. The track includes means for supporting the standard. The track also includes means for retaining the standard within the track. When the standard is engaged with the track, an upper surface of the opening contacts the means for supporting, and the means for retaining contacts a portion of the opening.

Any of the aspects of the present invention can be used individually or in combination with any one or more of the other aspects of the present invention.

Figure 3:
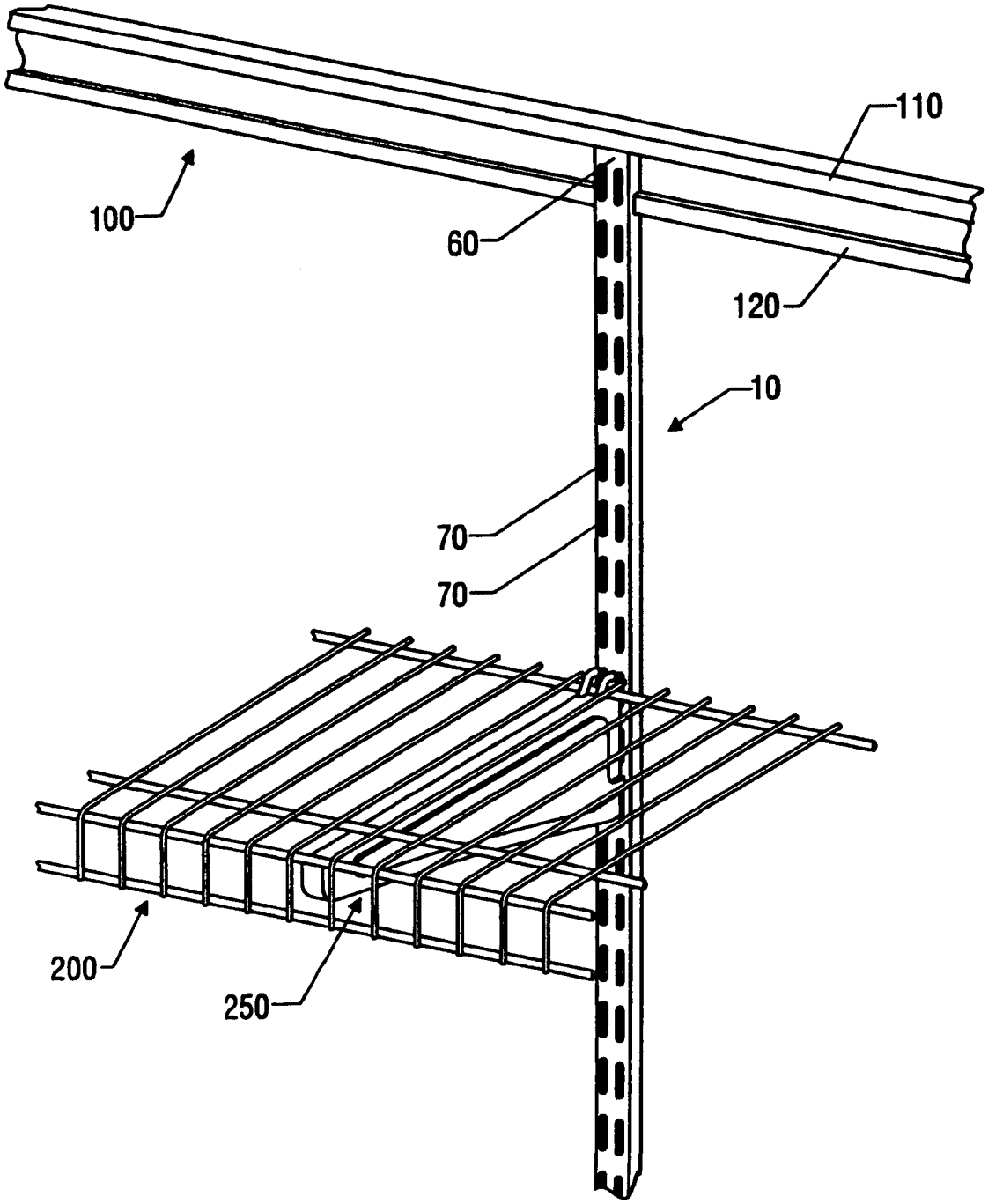
FIG. 3 is a perspective view of an embodiment of a shelving apparatus, with a bracket and a shelf mounted to the standard.

In FIG. 1, there is shown a cross-sectional side view of a shelving apparatus according to one exemplary embodiment of the invention. As shown, the shelving apparatus comprises a standard 10 and a track 100. The embodiment of the standard 10 shown comprises a front surface 50, a back surface 55, and a top portion 60. The front surface 50 defines slots 70 (as shown in FIG. 3), which in other embodiments can be of any size and shape such that a shelving bracket may be mounted thereto. Alternatively, instead of slots, any other means of mounting a bracket, such as protrusions, may be used on front surface 50.

As shown in FIG. 1, the back portion 55 of the standard 10 defines an opening 20 for supporting the standard 10 on the track 100. The opening 20 defines an upper surface 30 and a lower surface 40. The opening 20 is preferably shaped such that the upper and lower surfaces 30 and 40 are generally horizontal in orientation. The opening 20, however, can be of any shape such that it can receive and be supported by an opposing supporting member and is preferably slidable along that member. The opening 20 can be located on any portion of the standard such that it is supported by engaging with a track.

Also shown in FIGS. 1 and 3 is a track 100, which can be mounted on a wall or other surface, preferably horizontally. Track 100 may be constructed of any material suitable for standards or brackets, such as steel or aluminum. Track 100 also has a length such that standard 10 can preferably slide horizontally along the length of the track 100.

As shown in FIG. 1, the cross-section of an embodiment of track 100 is preferably generally shaped like a backward S. The track 100 also defines a front lip 110 that is designed to abut the front surface 50 of the standard 10 such that the standard 10 is held within track 100. Lip 110 preferably extends some distance over the top portion 60 of standard 10 and comes into contact with the front surface 50 such that when jarred or otherwise moved, the standard 10 is not released from the track 100. Any means, however, such as a latch or other mechanism can also be used in place of the lip 110, as long as the standard 10 remains held within track 100.

Track 100 also defines a support portion 120 that, when engaged with the opening 20, supports the standard 10 and prevents (or at least inhibits) the standard 10 from being pushed upward and separated from track 100. In one embodiment of track 100, support portion 120 (as shown in cross section in FIG. 1) is generally U-shaped and is adapted to extend into opening 20 on standard 10.

With continued reference to FIG. 1, support portion 120 includes upper surface 140 and bottom surface 150. Upper surface 140 supports standard 10, such as when a shelf and shelving bracket and the contents of the shelf are connected to the standard 10. Bottom surface 150 prevents (or at least inhibits) standard 10 from being disengaged from track 100 if the standard 10 is pushed or jarred in an upward direction by engaging with lower surface 40 of opening 20.

Support portion 120 may also be designed to allow standard 10 to slide horizontally along the track if desired, as shown in FIG. 3. Once in a desired position, the portion of the standard 10 not engaged with the track 100 may thereafter be secured to a wall to prevent (or at least inhibit) any further movement of the standard 100 from its desired position.

Alternative embodiments of support portion 120 may also be used. In such alternative configurations, the support portion need only provide an upper and bottom surface adapted to engage opening 20, or other means to support the standard 10 while preferably allowing the standard to slide if desired. Additionally, support portion 120 is not required to be at the bottom of track 100, but can be located at any place on the track 100 such that the support portion 120 can engage with an opening on the back surface of a wall standard and preferably provide one or more of the benefits as described herein. Preferably, however, support portion 120 is located in a position that when inserted into opening 20, lip 110 will be engaged with front surface 50 of standard 10. Thus, as shown in FIG. 1, distance y (the distance between the top 60 of the standard and bottom of the lip 110) is preferably greater than distance x (the spaced distance between the lower surface 40 and bottom surface 150 when the upper surface 140 of the track 100 is in contact with the upper surface 30 of the standard's opening 20). Also, track 100 may be of any cross-sectional design, and such alternative cross-sectional design can provide one or more of the benefits described herein.

Figure 4:
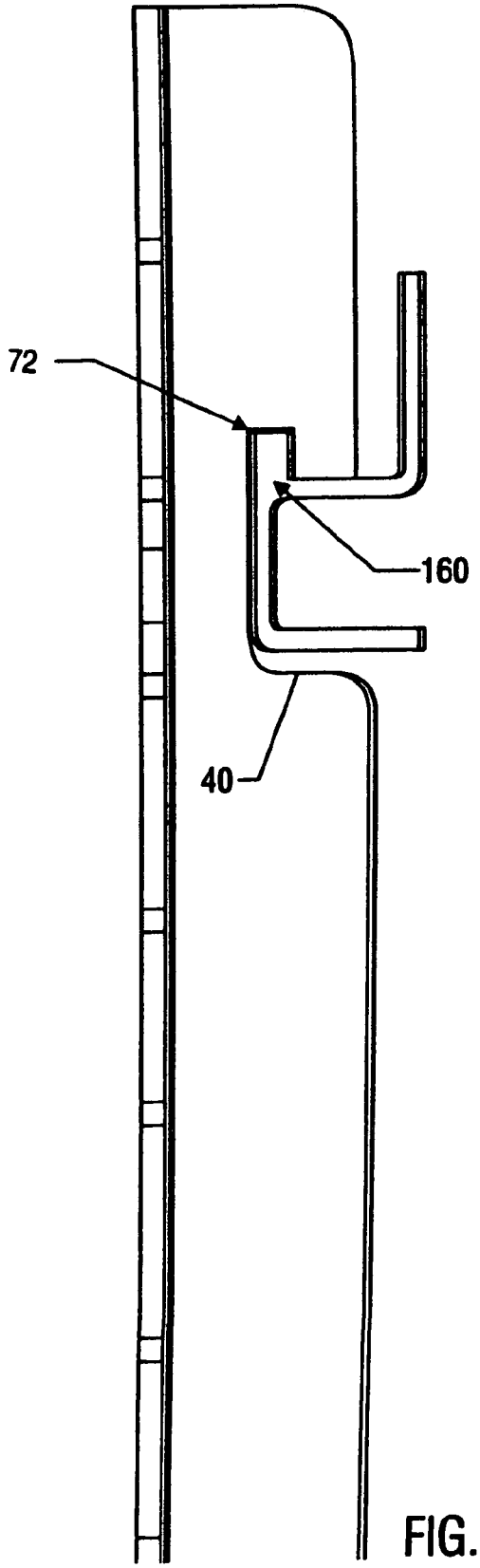
FIG. 4 is a side view of an alternative embodiment of a shelving apparatus.

In an alternative embodiment as shown in FIG. 4, lip 110 may be eliminated altogether by support portion 120 both providing support and keeping the standard 10 connected to the track. For example, support portion 120 can comprise not only upper and bottom surfaces 140 and 150, but can comprise extension 160 that provides the same function as did the lip 110. In one such embodiment (as shown in FIG. 4), extension 160 prevents the standard 10 from disengaging from the track 100 by engaging a notch or hole 72 in opening 20. The notch 72 and extension 160 may be located on the opening 20 and support member 120 respectively (or vice versa) in any position such that they can engage each other and prevent the standard 10 from disengaging from track 100. The standard 10 is also preferably slidable along the track 100 in this embodiment.

A method of mounting the standard 10 to track 100 is also disclosed herein. Track 100 is first secured to a wall or other surface, preferably in a substantially horizontal manner. A top portion of the standard 10 is then inserted under lip 110 and standard 10 rotated such that the opening 20 on the back 55 of the standard 10 engages the support portion 120 of the track 100. The standard 10 may then be slid along track 100 until it is in a desired position and then attached to the wall to prevent further movement along the track 100.

Figure 2:
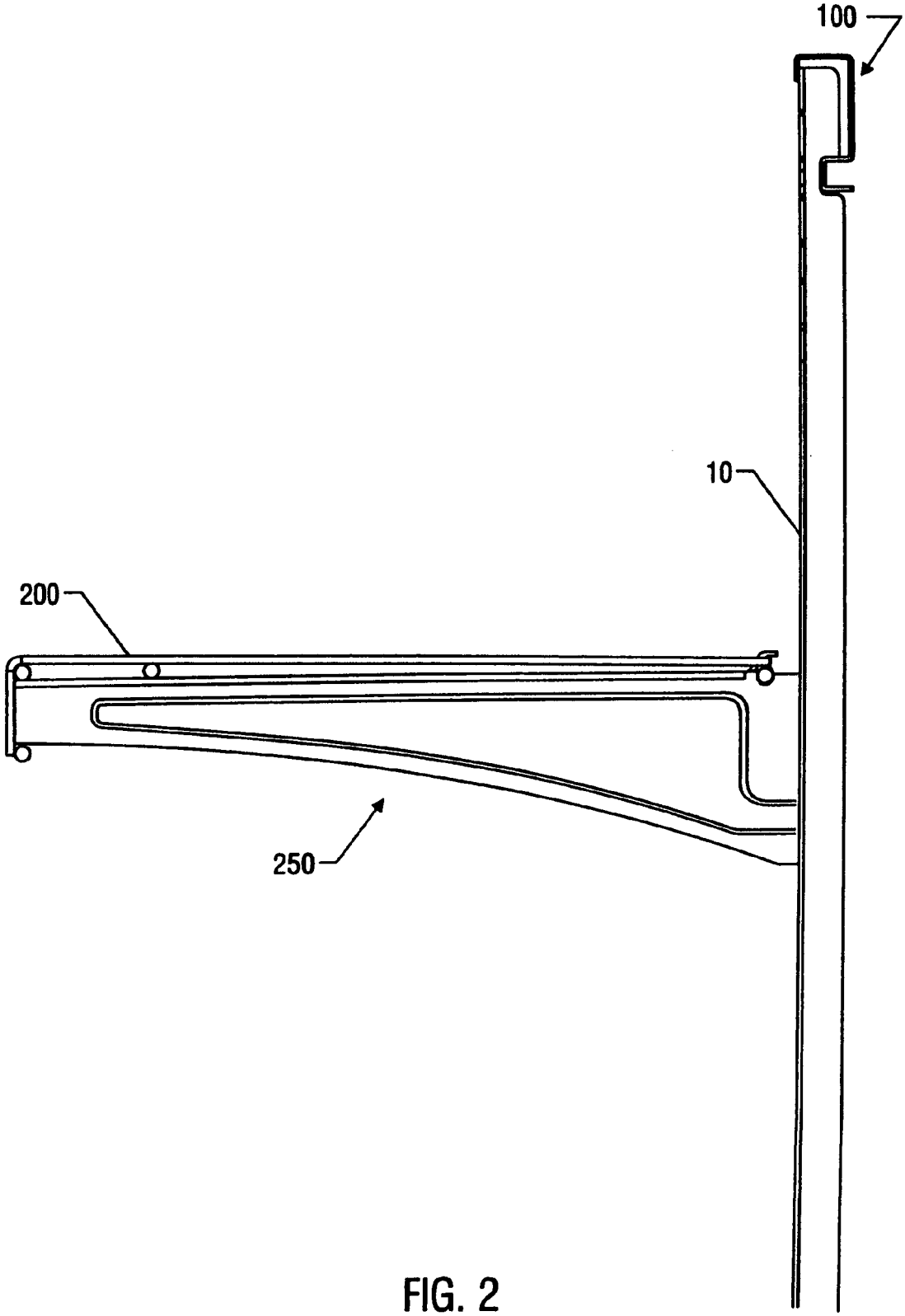
FIG. 2 shows a side view of an embodiment of a shelving apparatus, with a standard having a bracket and a shelf mounted thereon.

As shown in FIGS. 2 and 3, standard 10 and track 100 may be used in combination with a shelf 200 and/or shelving bracket 250. Such bracket and shelf can be of any type ordinarily used with vertical wall standards. As described above, standard 10 in combination with track 100 not only preferably allows standard 10 to be horizontally moved so that bracket 250 and shelf 200 can be supported in a position desired by the consumer, but also provides additional support and increased loading capacity for the shelf and bracket.

These examples are included to demonstrate preferred embodiments of the invention. It should be appreciated by those of skill in the art that the techniques disclosed in the examples represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present invention and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A shelving apparatus comprising a track and a shelf standard, the track including a support portion having an upper substantially horizontal planar support surface and a lower substantially horizontal planar surface vertically spaced from and connected to said upper substantially horizontal planar support surface by a connecting portion such that a spaced distance separates the upper and lower substantially horizontal planar support surfaces from each other, and an extension extending generally outwardly from the support portion, the shelf standard including a back surface having an opening, the opening including a portion that engagingly receives the extension of the support portion, and an upper substantially horizontal planar surface that contacts the upper substantially horizontal planar support surface of the support portion when the upper and lower substantially horizontal planar support surfaces of the support portion are at least partially within the opening, whereby engagement of the extension within the portion of the opening inhibits disengagement of the standard from the track;

a bracket engageable with a front surface of the shelf standard, and a shelf supportable by the bracket; wherein the front surface of the shelf standard includes a plurality of apertures, and wherein the bracket is mountable to one or more of the apertures.

2. The apparatus of claim 1, wherein the portion of the opening that receives the extension comprises a notch.

3. The apparatus of claim 2, wherein the notch has a generally rectangular transverse profile, and wherein the extension has a generally rectangular transverse profile.

4. The apparatus of claim 1, wherein the shelf standard is slidably movable along the track.

5. The apparatus of claim 1, wherein the upper and lower substantially horizontal planar support surfaces and the connection portion of the support portion, excluding the extension, collectively define a generally U-shaped transverse profile, and wherein the opening, excluding the portion that receives the extension, includes a generally U-shaped transverse profile.

6. The apparatus of claim 1, wherein the extension extends generally upwardly from the upper substantially horizontal planar support surface of the track, and wherein the portion of the opening that engages said extension extends generally upwardly from the upper substantially horizontal planar surface of the opening.

7. The apparatus of claim 1, wherein the extension extends generally vertically from the support portion, and wherein the portion of the opening extends generally vertically from the opening.

8. The apparatus of claim 1, wherein the opening includes a lower substantially horizontal planar surface vertically spaced from the opening's upper substantially horizontal planar surface, wherein a spaced distance separates the opening's lower substantially horizontal planar support surface from the support portion's lower substantially horizontal planar surface when the support portion is within the opening such that, when the shelf standard is moved upward relative to the track, contact between the opening's lower substantially horizontal planar surface and the support portion's lower substantially horizontal planar support surface can inhibit disengagement of the shelf standard from the track.

9. The apparatus of claim 1, wherein the extension includes an upper substantially horizontal planar surface, and wherein the portion of the opening that engages said extension includes an upper substantially horizontal planar surface that contacts the extension's upper substantially horizontal planar surface when the support portion is within the opening.

10. The apparatus of claim 1, wherein the extension includes front and back substantially vertical planar surfaces, and wherein the portion of the opening that engages said extension includes front and back substantially vertical planar surfaces for respectively contacting the extension's front and back substantially vertical planar surfaces for inhibiting disengagement of the shelf standard from the track.

11. The apparatus of claim 1:

wherein the extension includes:

an upper substantially horizontal planar surface; and front and back substantially vertical planar surfaces extending upwardly from the support portion's upper substantially horizontal planar support surface towards the extension's upper substantially horizontal planar support surface;

wherein the portion of the opening that engages said extension includes:

an upper substantially horizontal planar surface that contacts the extension's substantially horizontal planar surface when the support portion is within the opening; and front and back substantially vertical planar surfaces extending upwardly from the opening's upper substantially horizontal planar surface towards the upper substantially horizontal planar surface of the portion of the opening, the front and back substantially vertical planar surface configured for respectively contacting the extension's front and back substantially vertical planar surfaces for inhibiting disengagement of the shelf standard from the track.

12. The apparatus of claim 1, wherein the extension is configured for contacting at least one surface defining at least a portion of the opening when the support portion is within the opening.

13. A method of supporting a shelf standard with a track, the track including a support portion having an upper substantially horizontal planar support surface and a lower substantially horizontal planar surface vertically spaced from and connected to said upper substantially horizontal planar support surface by a connecting portion such that a spaced distance separates the upper and lower substantially horizontal planar support surfaced from each other, and an extension extending generally outwardly from the support portion, the shelf standard including a back surface having an opening configured to engagingly receive the support portion, the opening including a portion configured to engagingly receive the extension of the support surface, the method comprising positioning the shelf standard relative to the track such that the portion of the opening engages the extension, the opening engages the support portion of the track with the upper and lower substantially horizontal planar support surfaces of the support portion at least partially within the opening, and the upper substantially horizontal planar support surface of the support portion contacts an upper substantially horizontal planar surface of the opening;

the method further comprising mounting at least one bracket on a front surface of the shelf standard, wherein the front surface of the shelf standard includes a plurality of apertures, and wherein the bracket is mountable within one or more of the apertures; the method further comprising mounting a shelf on the at least one bracket.

14. The method of claim 13, wherein positioning includes, after the extension is at least partially received within the portion of the opening, rotating the shelf standard relative to the track to cause the opening to engage the support portion of the track.

15. The method of claim 13, further comprising attaching the track to a surface.

16. The method of claim 13, further comprising sliding the shelf standard along the track.

17. The method of claim 16, further comprising attaching the shelf standard to a surface after sliding the shelf standard along the track.

18. The method of claim 13, wherein the portion of the opening that receives the extension comprises a notch.

19. The method of claim 13, wherein the extension extends generally upwardly from the upper substantially horizontal planar support surface of the track, and wherein the portion of the opening extends generally upwardly from the upper substantially horizontal planar surface of the opening.

20. The method of claim 13, wherein the extension extends generally vertically from the support portion, and wherein the portion of the opening extends generally vertically from the opening.

* * * * *